United States Patent [19]

Debaigt

[11] 4,284,316

[45] Aug. 18, 1981

[54] TERMINAL BLOCK

[75] Inventor: Jean Debaigt, Maisons Laffitt, France

[73] Assignee: CGEE Alsthom, Levallois-Perret, France

[21] Appl. No.: 83,704

[22] Filed: Oct. 11, 1979

[51] Int. Cl.[3] ..... H01R 4/24

[52] U.S. Cl. ..... 339/98; 339/107; 339/113 R; 339/198 J

[58] Field of Search ..... 339/97 R, 97 P, 98, 339/99, 107, 198 R, 198 J, 113 R

[56] References Cited

U.S. PATENT DOCUMENTS

| | | | |
|---|---|---|---|
| 3,118,715 | 1/1964 | Potruch | 339/98 |
| 3,573,713 | 4/1971 | Enright et al. | 339/113 R |
| 3,718,888 | 2/1973 | Pasternak | 339/98 |
| 3,835,444 | 9/1974 | Plana et al. | 339/98 |
| 3,899,236 | 8/1975 | Santos | 339/98 |
| 3,945,705 | 3/1976 | Seim et al. | 339/98 |
| 4,033,661 | 7/1977 | Moody et al. | 339/98 |
| 4,153,326 | 5/1979 | Frantz et al. | 339/99 R |

FOREIGN PATENT DOCUMENTS

| | | | |
|---|---|---|---|
| 312726 | 1/1974 | Austria . | |
| 7037596 | 8/1971 | France . | |
| 7127343 | 4/1972 | France . | |
| 7312448 | 11/1973 | France . | |
| 1293970 | 10/1972 | United Kingdom | 339/98 |

*Primary Examiner*—John McQuade

*Attorney, Agent, or Firm*—Sughrue, Mion, Zinn, Macpeak and Seas

[57] ABSTRACT

The invention relates to an automatic-connection terminal block for connecting two conductor wires together, said terminal block including an insulating box and a cover which co-operates therewith. The terminal block is characterized in that the insulating box (1) includes two longitudinal channels (3) spaced apart from each other. The ends thereof, have openings (30) which lead to the periphery of the terminal block and said conductor wires are inserted through said openings. The channels each have a first transversal slot (31). The cover (21) is provided with a connecting part (4) which has two transversal contact blades (5) each with a transversal slot (50), so that when the cover is fitted on the box, each blade enters one of said slots, and said slots surround said conductor wires. The invention applies to connecting together conductor wires of telecommunications circuits.

3 Claims, 4 Drawing Figures

TERMINAL BLOCK

FIELD OF THE INVENTION

The invention relates to a terminal block and in particular to an automatic-connection terminal for connecting together two conductor wires of small cross-section such as those used in telecommunications cables. Usually, connection between two conductor wires on a terminal block requires the ends of these wires to be cut to the required length, the stripping of the ends and the conductive ends to be appropriately clamped on the same terminal block.

The invention aims to provide a terminal block which allows these operations as a whole to be performed simultaneously and automatically, easily and rapidly.

SUMMARY OF THE INVENTION

The invention provides an automatic-connection block for connecting two conductor wires together. The terminal block includes firstly, an insulating box which includes two parallel longitudinal channels, the ends thereof having openings which lead to the periphery of the terminal block. The conductor wires are inserted through said openings. The channels each have a first transversal slot, and secondly a cover provided with a connecting part which has two transversal contact blades each with a transversal slot and co-operating with the said box so that when the cover is fitted on the box, each blade enters one of said slots. Said slots surround said conductor wires. One of said channels has a second transversal slot and the connecting part includes a transversal knife so that when the cover is fitted on the box, said knife co-operates with said second slot to cut the conductor wire disposed in said channel with the end of the cut wire possibly passing through the opening facing said channel.

According to one embodiment, the side of the insulating box has a longitudinal slot which leads into the adjacent channel and the end openings.

According to another embodiment, the two longitudinal channels have a first common slot and the connecting part includes a common contact blade which has two transversal slots so that when the cover is fitted on the box, said common blade enters said first common slot.

According to another embodiment, the channels have a second common slot and the connecting part includes a common knife so that when the cover is fitted on the box, said common knife co-operates with said second common slot to cut the conductor wires with the ends of said wires possibly passing through the opening facing each channel.

The openings of the channels can be constituted by cut-outs in the bearing surface of the box which is fitted against the cover.

Embodiments of the invention are described by way of example with reference to the accompanying drawings.

DESCRIPTION OF PREFERRED EMBODIMENTS

Figure 1:
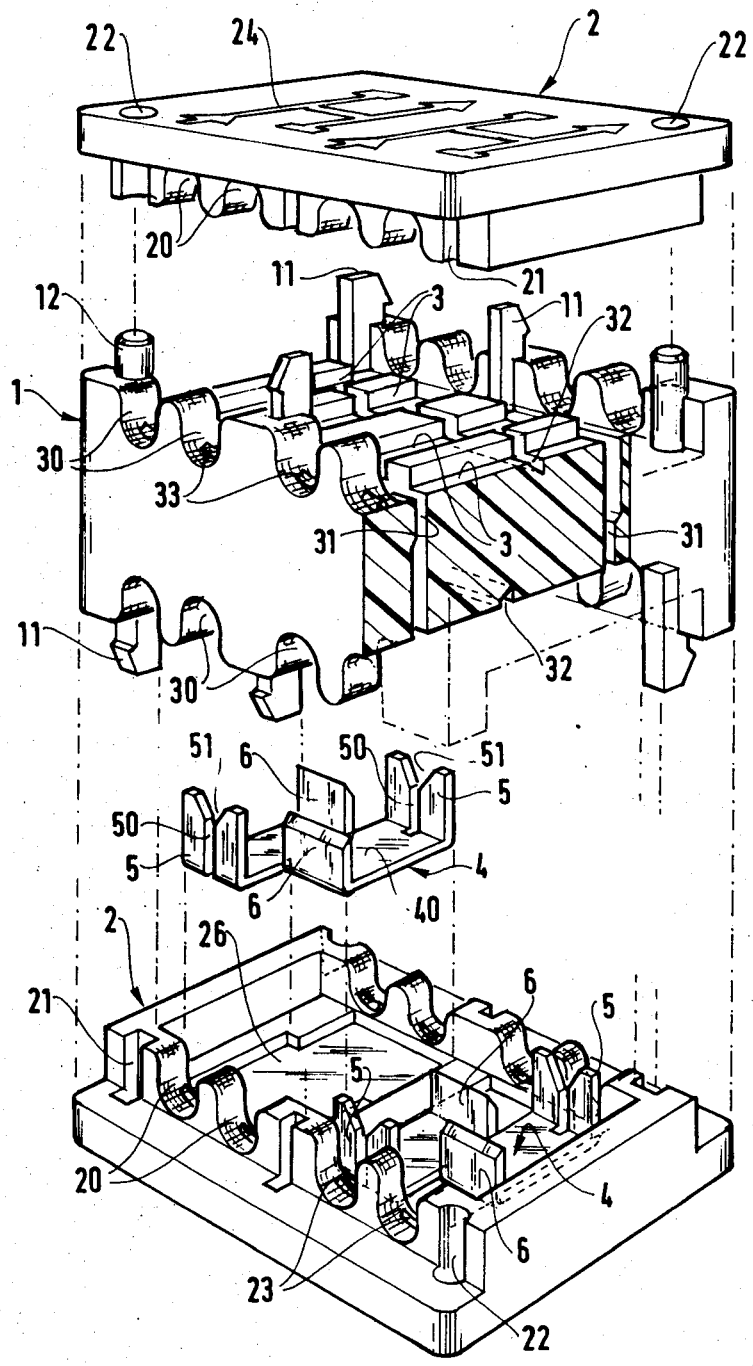
FIG. 1 is a partially exploded perspective view showing a partial cross-section of a terminal block in accordance with the invention.
Figure 2:
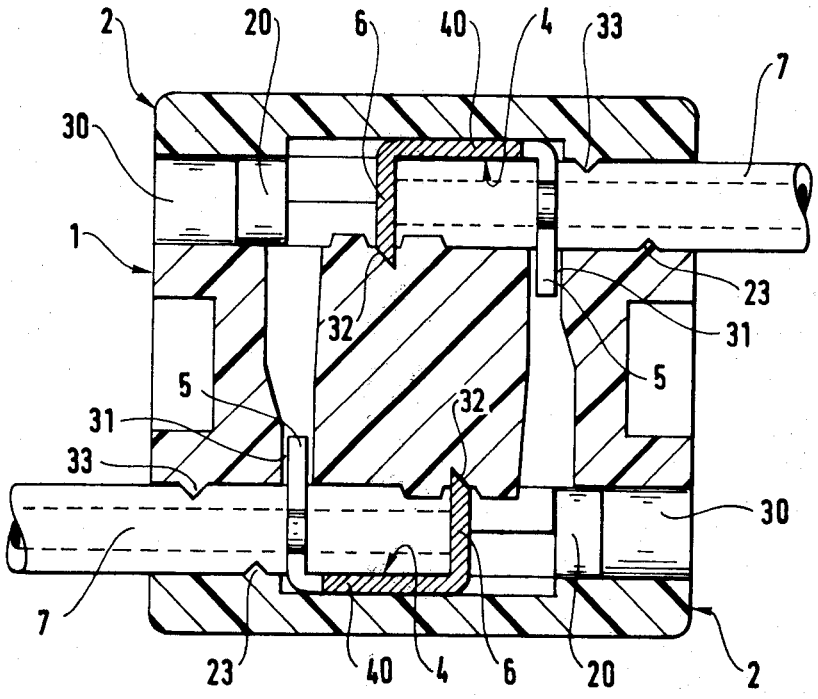
FIG. 2 is a longitudinal cross-section of the connection unit illustrated in FIG. 1 in the assembly position.

The figures illustrate a terminal block which includes an insulating box 1 and two identical insulating covers 2 which are intended to close the upper and lower surfaces of the box. For this purpose, the housing includes, in a known manner, both locking latches 11 which co-operate in cavities 21 in the covers 2, and guide studs 12 disposed diagonally on each surface of the box and co-operating with corresponding holes 22 in the covers.

Each of the upper and lower surfaces of the box includes longitudinal channels 3 which lead to the periphery of the box via openings 30 constituted by notches in these surfaces. Each channel 3 includes a first transversal slot 31 and a second transversal slot 32, these slots extending beyond the side walls and the bottom of the channel.

The covers 2 also have openings 20 constituted by notches disposed facing the openings 30 of the box, but shifted longitudinally and cut-outs 26 intended for accommodating connecting parts 4.

The connecting parts 4 are U-shaped and each has a base 40 with, side by side at each end and for each channel, a contact blade 5 and a knife 6. In each pair of adjacent channels, the relative positions of the contact blades 5 and of the knives 6 are alternate, while these components are interconnected by the base 40 which is common to them. Between the base and the free end of each contact blade adjacent to the box, each contact blade includes a slot 50 with a flared opening 51.

The terminal block is used as follows. The conductors 7 are inserted in the channels 3 and in the openings 30 on the surface concerned of the box 1. Then the box 1 provided with the connection parts 4 is applied on this surface so as to make the guide studs 12 enter the holes 22 and the locking latches 11 enter the cavities 21. During this operation, the contact blades 5 enter the first slots 31 and the knives enter the second slots 32. Slots 31 extend transversely to the channel and completely through the box 1, while transverse slots 32 are sized to the cutting edges of knives 6 and closely receive the cutting edges. This guides the insulated conductors 7 through the opening 51 and the contact blade 5 and inserts them in the slot 50. The insulation of the wires ends at the edges of the slots 50 which come into contact with the conductive core of the wires 7. Then electric contact is established between the conductor wires of the same conductor wire pairs as disposed in two adjacent channels via the contact blades connected to the common base 40 of the connecting part 4. Simultaneously, the knives 6 enter the second slots 32 and cut the ends of the conductor wires 7 which can be removed through the openings 30 and 20. A stud 33 which projects from the bottom of the channel 3 between the contact blade 5 and the adjacent opening 30, as well as a lock stud 23 disposed on the cover bites into the insulation of the conductor wire 7 to lock it in the channel. The connection diagram showing the connections formed by the connection unit is referenced 24 and is illustrated on the outside of the cover.

Figure 3:
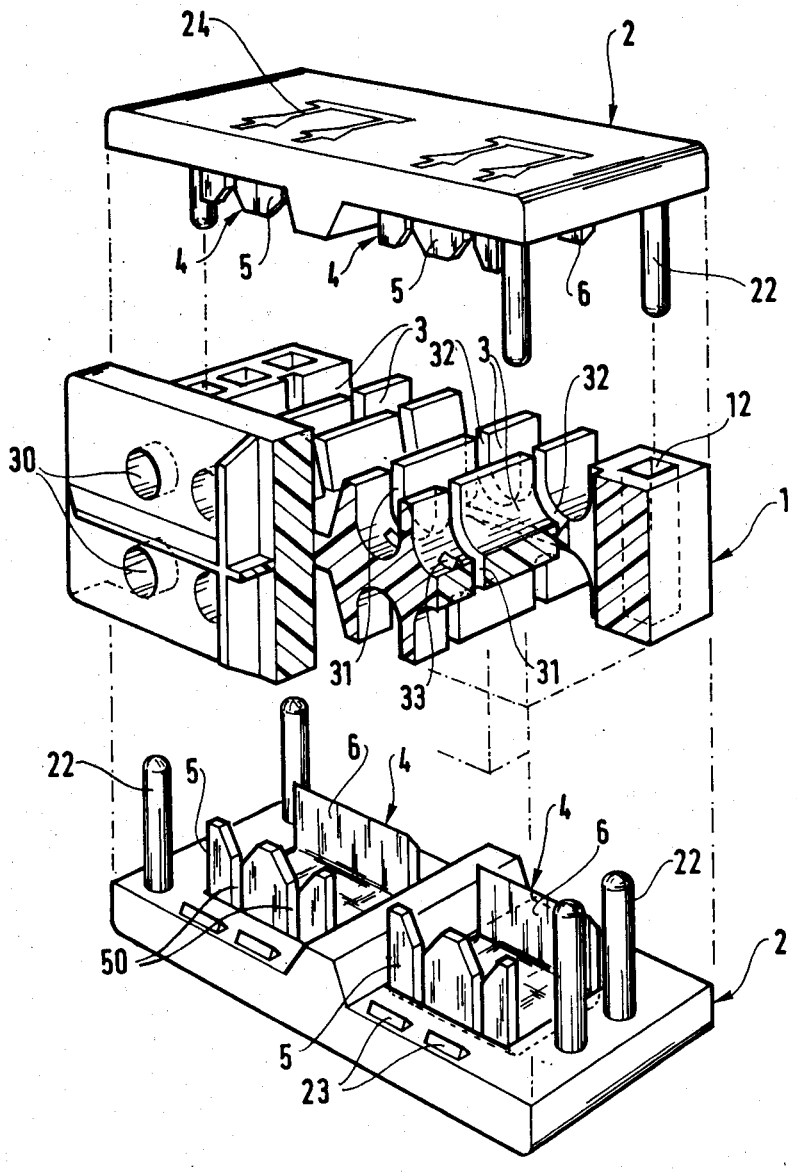
FIG. 3 is a partially exploded perspective view showing a partial cross-section of a variant of a terminal block.

In the variant illustrated in FIG. 3, each pair of adjacent channels 3 includes a first common transversal slot 31 and a second common transversal slot 32. Likewise, each connecting part 4 with which the cover 2 is fitted includes a common contact blade 5 and a common knife 6 for each pair of adjacent channels. Further, the openings 30 of each of the channels 3 are constituted on one side by holes in the transversal surfaces of the box. The covers 2 no longer include openings 20 and the locking latches and the guide studs are replaced by simple studs 22 which co-operate with the holes 12 in the box.

In this embodiment, the conductor wires must be inserted in the channels through the openings 30.

Figure 4:
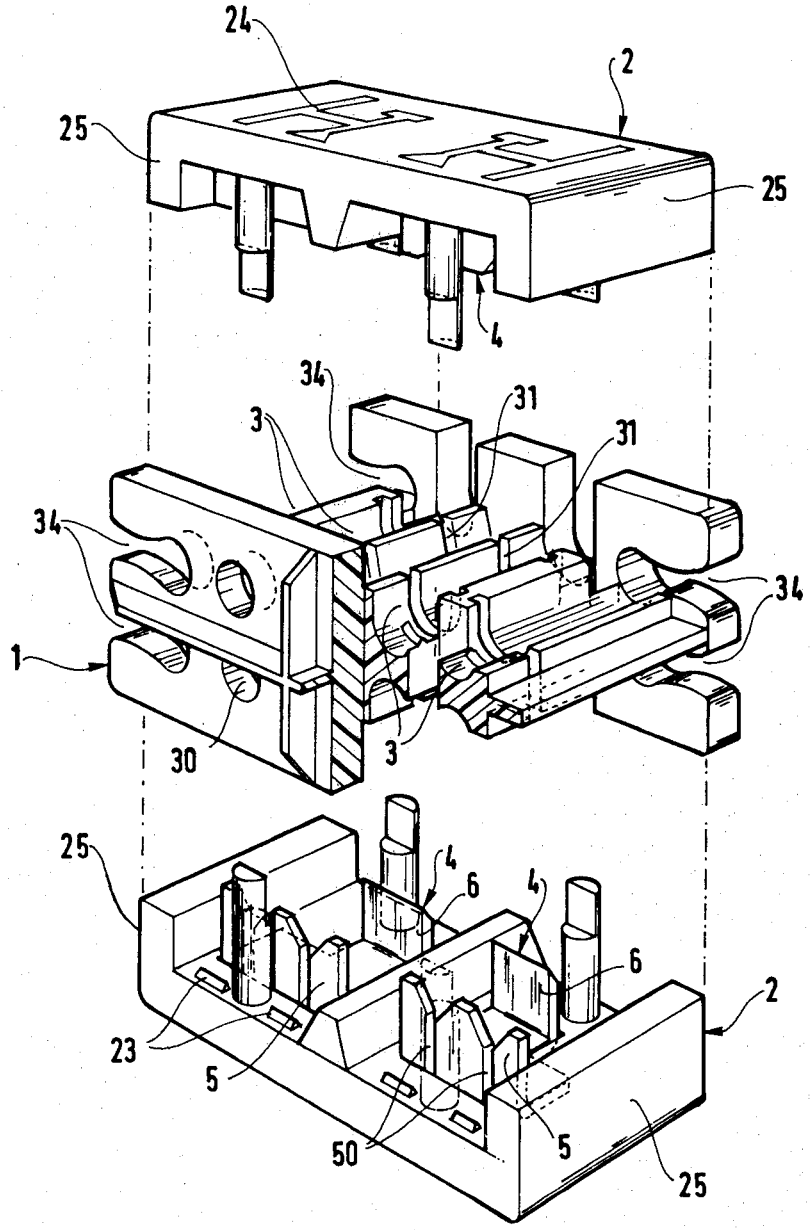
FIG. 4 is a partially exploded perspective view showing a partial cross-section of another variant of a terminal block.

In the variant illustrated in FIG. 4, the connecting part 4 includes no knife 6 except opposite only one channel 3 of a pair of adjacent channels. This makes it possible to hold one conductor wire in the terminal block.

For this purpose, to facilitate the insertion of the wire in a channel of the box without having to pass it through the end openings 30, the channel situated on the side edge of the box includes a longitudinal opening 34 which leads into the channel and the end openings 30. In this case, the covers include side walls 25 which overlap the openings 34 in the closed position on the box 1. Each of these variants corresponds to a different connection diagram 24.

I claim:

1. An automatic connection terminal block for connecting multiple wires end to end, said terminal block comprising:

an insulating box, two independent and identical insulating covers for mounting to upper and lower surfaces of said insulating box, said insulating box having pairs of adjacent, longitudinal channels on said upper and lower surfaces, each cover having cut-outs aligned with channels, said cut-outs bearing connecting parts corresponding to said pairs of adjacent longitudinal channels on said upper and lower surfaces of said insulating box, each connecting part having four blades, said blades being lined up two by two, said four blades being electrically interconnected, each two lined up blades comprising a slotted blade and a knife blade, said box bearing on said upper and lower surfaces a first transversal slot at each slotted blade location for said cover borne connecting part, said first transversal slots extending through said insulating box and transversely of a longitudinal channel, and a second blind transversal slot for the same longitudinal channel, said second blind transversal slot being sized to the cutting edge of said knive blade and closely receiving the cutting edge of said knife blade, when said insulating cover is pressed against said multiple wires presented to said channels with said slotted blade severing the insulation of the multiple wires to effect electrical contact with the conductive wire core, and said knife blades serving the ends of respective wires.

2. The automatic connection terminal block according to claim 1, wherein the four blades of the connecting parts are interconnected by a common base, with the knive blades and slotted blades being alternated and longitudinally offset.

3. The automatic connection terminal block according to claim 1, wherein the channels of the insulating box are notched corresponding to notches within the insulated covers such that the insulation of the multiple wires are frictionally locked by studs disposed within said channel adjacent the ends of said insulating box and notches within said insulating cover which are aligned therewith.

* * * * *